US008584387B2

(12) United States Patent
Pénisson

(10) Patent No.: US 8,584,387 B2
(45) Date of Patent: Nov. 19, 2013

(54) DISPLAY ASSEMBLY FOR POSTERS AND THE LIKE

(75) Inventor: Gérard Pénisson, Montreal (CA)

(73) Assignee: 3411745 Canada Inc., Saint-Bruno-de-Montarville (CA)

( * ) Notice: Subject to any disclaimer, the term of this patent is extended or adjusted under 35 U.S.C. 154(b) by 34 days.

(21) Appl. No.: 12/743,337

(22) PCT Filed: Nov. 16, 2007

(86) PCT No.: PCT/CA2007/002055
§ 371 (c)(1), (2), (4) Date: Sep. 22, 2010

(87) PCT Pub. No.: WO2008/113154
PCT Pub. Date: Sep. 25, 2008

(65) Prior Publication Data
US 2011/0023344 A1 Feb. 3, 2011

(51) Int. Cl.
*G09F 7/02* (2006.01)

(52) U.S. Cl.
USPC ..... 40/711; 40/361; 40/600; 40/533

(58) Field of Classification Search
USPC ..... 40/600, 711, 773, 793, 799, 361–367; D19/88
See application file for complete search history.

(56) References Cited

U.S. PATENT DOCUMENTS

| | | | | | |
|---|---|---|---|---|---|
| 1,895,938 | A * | 1/1933 | Mutschler | 40/611.02 |
| 3,659,365 | A * | 5/1972 | Eaton | 40/649 |
| 3,927,483 | A * | 12/1975 | Candor | 40/530 |
| 4,258,493 | A * | 3/1981 | Kettlestrings et al. | 40/600 |
| 4,907,361 | A * | 3/1990 | Villard | 40/565 |
| 5,167,087 | A * | 12/1992 | Plumly | 40/600 |
| 5,197,213 | A * | 3/1993 | Borden | 40/737 |
| 5,430,964 | A * | 7/1995 | Inbar et al. | 40/361 |
| 5,442,871 | A * | 8/1995 | Sarkisian et al. | 40/606.17 |
| 5,457,905 | A * | 10/1995 | Kaplan | 40/574 |
| 5,608,980 | A * | 3/1997 | Pangerl | 40/793 |
| 5,680,709 | A * | 10/1997 | Stone | 33/613 |
| 5,683,018 | A * | 11/1997 | Sullivan et al. | 223/85 |
| 5,781,980 | A * | 7/1998 | Golston | 29/450 |
| 5,890,305 | A * | 4/1999 | Inbar et al. | 40/361 |
| 6,011,528 | A * | 1/2000 | Inbar et al. | 345/77 |
| 6,038,803 | A * | 3/2000 | Wilkins | 40/773 |
| 6,041,983 | A * | 3/2000 | Sullivan et al. | 223/85 |
| 6,298,591 | B1 * | 10/2001 | Healy | 40/600 |
| 6,308,446 | B1 * | 10/2001 | Healy | 40/600 |
| 6,405,465 | B2 * | 6/2002 | Dwyer et al. | 40/594 |
| 6,550,172 | B2 * | 4/2003 | Korpai | 40/725 |
| 6,817,128 | B2 * | 11/2004 | Korpai | 40/725 |
| 6,883,260 | B1 * | 4/2005 | Cobb et al. | 40/611.08 |
| 2002/0078612 | A1 * | 6/2002 | Meacham et al. | 40/711 |
| 2006/0000135 | A1 * | 1/2006 | Yoon | 40/799 |
| 2006/0162215 | A1 * | 7/2006 | McVay | 40/799 |
| 2009/0165351 | A1 * | 7/2009 | Hsu | 40/799 |

* cited by examiner

*Primary Examiner* — Joanne Silbermann
*Assistant Examiner* — Shin Kim
(74) *Attorney, Agent, or Firm* — Brouillette & Partners; François Cartier; Robert Brouillette

(57) ABSTRACT

The present invention provides a display assembly for posters and the like having a protective sheet that may be replaced with no need to dismount the frame. The protective sheet comprises a strip allowing the sheet to be flexed outwardly to change the display. The display assembly further comprises at least one frame cover which is removably connected to the frame member. The display assembly may be configured to allow the posters to be viewed from both sides.

20 Claims, 9 Drawing Sheets

DISPLAY ASSEMBLY FOR POSTERS AND THE LIKE

CROSS-REFERENCE TO RELATED APPLICATIONS

The present patent application claims the benefits of priority of commonly assigned International Patent Application no. PCT/CA2007/002055, entitled "Display Assembly for Posters and the Like" and filed on Nov. 16, 2007.

FIELD OF THE INVENTION

The present invention generally relates to a display assembly to receive posters and the like.

BACKGROUND OF THE INVENTION

Various assemblies have been used in the past for the display of posters and other sheet materials such as advertisements, photographs, drawings and the like. Whenever the applicant refers to "poster" or "display sheet" in this document, it should be understood to include any such sheet materials. Some of these assemblies are constructed to be particularly useful in situations where it is wished to change the display sheet at certain time intervals. They are constructed in a manner that they allow the easy replacement of the display sheet. They generally have a frontal transparent protective sheet which allows the display sheet to be seen while being protected against theft, vandalism or the elements.

Also, some display assembly users, such as advertising network operators, need to differentiate advertising networks, both for public and operator personnel responsible for poster replacement. In several instances also, several display assemblies are contiguous but part of different networks making it difficult for operator personnel to distinguish them apart. As examples of networks, there are pharmacies, culture, tobacco products, display assemblies allowed to be within a certain distance from schools (to comply with regulatory restrictions), etc. . . . Attempts have been made to identify display assemblies by color identification, sometimes made by installing a cover on the frame. These covers are useful because they create different appearances for display assemblies, without requiring manufacturing, purchasing and having in stock different display assemblies, otherwise necessary.

It is not rare however that such frontal transparent protective sheet and/or such cover be at times defaced, damaged, obliterated or removed by vandals or need to be replaced for other reasons.

Attempts have been made to have display assemblies which allow for the replacement of such frontal transparent protective sheet but it is still necessary to dismount the display assembly to change the transparent sheet which is cumbersome, expensive and time consuming.

Also, those attempts that have been made to have such color identification made by having a cover installed on one frame member require the dismantlement of the assembly to replace or change the cover.

There is therefore a need for a display assembly which allow for the replacement of the frontal transparent protective sheet and/or the cover, without dismantling the assembly.

There is also a need to provide a display assembly that allows the display of two posters at a time, one being visible from the front and the other one from the back.

The invention presented in this document shows improvements made by the inventor to the Canadian patent no. 2,192,830.

SUMMARY OF THE INVENTION

It is an object of the present invention to provide a novel display assembly.

The present invention provides a display assembly in which the protective sheet could be replaced, when needed, without dismantling the assembly. Also, a frame cover is provided, allowing to easily create at low cost display assemblies of different appearances from one single type of display assembly, thus substantially reducing manufacturing and inventory costs, and also allowing its replacement, when needed, without dismantling the assembly.

The aforesaid and other objectives of the present invention are realized by generally providing an assembly for the display of sheets, posters or the like, comprising a frame formed of a plurality of members having abutting surfaces, one of the members being rectilinear; a flexible protective sheet having at least one longitudinal edge, the flexible protective sheet having a strip having a portion extending outwardly along the edge; a groove in the rectilinear frame member adapted to removably receive and retain the portion of the strip; means to magnetically hold the protective sheet to the frame members against the abutting surfaces; at least one frame cover, wherein one of the frame members is adapted to receive the frame cover, the frame cover being adapted to be removably connected to a frame member to change the appearance of the display assembly without dismantling the display assembly; and wherein the protective sheet is flexible outwardly about the strip, and wherein one of the display sheets, posters or the like may be inserted rearwardly of the protective sheet and wherein the flexible protective sheet is retained in the assembly by the magnetic holding means.

In a preferred embodiment, the cover is adapted to be clipped on one of the frame member. In a further embodiment, the frame member comprises an internal portion and an external portion adapted to retain the cover on the frame member. In a still further embodiment, the shape of the cover is complementary to at least a portion of the frame member.

In a preferred embodiment, the protective sheet is removed or inserted into the groove by sliding the protective sheet in a direction perpendicular to the rectilinear frame member and the flexible protective sheet is removed from the groove without dismantling the display assembly.

In a preferred embodiment, the portion of the strip which extends outwardly comprises a longitudinal edge portion which is tapered, the tapered edge portion being adapted to be inserted into the groove.

In a preferred embodiment, the display assembly comprises a securing part and the securing part is adapted to apply a pressure on the portion of the strip. In a further embodiment, the securing part comprises at least one screw to secure the portion of the strip, and the rectilinear member comprises an opening through which the screw is screwed. In a still further embodiment, the cover hides the opening and the screw. In a preferred embodiment, the securing part is made from a resilient material.

In a preferred embodiment, the frame members having a surface susceptible to receive rainwater or snow slightly leans downward forcing water or snow to flow off from the frame member.

In a preferred embodiment, the frame members comprise ferromagnetic material part and the magnetic holding means comprise flexible strips of ferro-magnetic material attached to the protective sheet.

In a further preferred embodiment, the aforesaid and other objectives of the present invention are realized by generally providing an assembly for the display of sheets, posters or the like, comprising a frame formed of a plurality of members having abutting surfaces, one of the members being rectilinear; a flexible protective sheet having at least one longitudinal edge, the flexible protective sheet having a strip comprising a portion extending outwardly along the edge; a groove in the rectilinear frame member adapted to removably receive and retain the portion of the strip, wherein the protective sheet is removed or inserted into the groove by sliding the protective sheet in a direction perpendicular to the rectilinear frame member and wherein the flexible protective sheet is removed from the groove without dismantling the display assembly; means to magnetically hold the protective sheet to the frame members against the abutting surfaces; wherein the protective sheet is flexible outwardly about the strip, and wherein a display sheet may be inserted rearwardly of the protective sheet and wherein the flexible protective sheet is retained in the assembly by the magnetic holding means.

In a further embodiment, the display assembly comprises at least one frame cover, wherein the frame cover is adapted to be removably clipped on the frame member to change the appearance of the display assembly without dismantling the display assembly.

In a preferred embodiment, the outward portion of the strip comprises a longitudinal edge portion which is tapered, the tapered edge portion being adapted to be received in the groove.

In a still preferred embodiment, the display assembly further comprises a securing part and the securing part is adapted to apply a pressure on the portion of the strip. In a preferred embodiment, the securing part comprises at least one screw to secure the portion of the strip, and the rectilinear member comprises an opening through which the screw is screwed. In a still further embodiment, the securing part is made from a resilient material.

In order to facilitate the replacement of the protective sheet of the display assembly, a removable protective sheet is provided. If the protective sheet has been permanently damaged, the protective sheet is easily removed and replaced by a new one. The protective sheet comprises a strip that is attached thereto. A portion of the strip extends from the side of the protective sheet. This portion is inserted in a complementary receiving means disposed along one frame member that is rectilinear, hereinafter referred as a groove. The strip allows the flexible protective sheet to be flexed outwardly while the groove in the frame member receive and retain the portion of the strip extending outwardly. This provides easy manual disengagement of the protective sheet and the outward flexing of the protective sheet to allow its removal and the insertion of a new one. The strip is generally vertical but it is not limited to that case, indeed, the strip may be horizontal or otherwise as long as it is placed along an edge of the display.

At least one side of the portion of the strip engaged in the groove may be tapered. To secure the strip into the groove, a securing part may be used. The securing part may be a screw that presses against the strip and which is screwed on the frame member. The tapered portion may be press-fitted into the groove which comprises a securing part that presses against the tapered portion. In this case the securing part may be made of a resilient material.

The above display assembly may be directly mounted or attached on a surface, for example on a wall or a window, or the door of a store. In the case the display assembly is mounted on an opaque surface, the display assembly does not need any rear panel, since the poster to be displayed will be held between the protective sheet and the surface on which the display assembly is to be mounted or attached. However, in another embodiment both sides of the display assembly may be used to display material. This would be the case if the display assembly is mounted on a transparent surface such as a glass window or door, is hanged from above or is mounted on a freestanding support. In such instances both sides of the display assembly remain visible. In these cases, a transparent rear panel is provided on the other side of the display assembly to protect the display sheet and on which the display sheet will be disposed.

A supporting sheet, which is preferably opaque, may be installed in the display assembly behind the display sheet.

It is to be noted that both sides of the display assembly may have an interchangeable protective sheet. The frame members are then symmetrical and both sides have the same characteristics.

The frame of the display assembly is preferably made of extruded members. The frame members are connected through corners parts at their distal extremities and theses connections may be secured with fasteners. It is to be noted that, in the present document, the word "corner" refers to parts having different profiles depending of the shape of the display assembly.

At least one member of the frame is adapted to receive a frame cover in order to allow a change in its appearance and to hide screws or fastening means used to fix the display assembly on a surface. The cover is preferably made of an inexpensive material such as, for example, polyvinyl chloride (PVC) or acrylonitrile butadiene styrene (ABS). This cover may be changed from time to time for an esthetical effect or for identification purposes. The cover is preferably clipped on the frame, thus no special tools are needed for the replacement of the cover. Furthermore, there is no need to dismount the frame assembly to do so. Also, it is possible to have a cover that slides on the frame member. The cover may be composed by a plurality of sections.

The display assembly may be adapted to outdoor conditions, more particularly to rainwater. Indeed, in this case the top surface of the top member slightly leans downward, this angle forcing the water to flow off. Generally, frame members having a surface susceptible to receive rainwater or snow slightly leans downward forcing water or snow to flow off.

In another preferred form of the invention, the borders of the protective sheet are confined within the peripheral frame members so that it becomes difficult to grip the protective sheet with fingers in order to flex it outwardly. Also, such construction improves the weatherproof feature of the display assembly by preventing weather elements to reach the display sheet.

In one preferred form of the invention, a removable suction cup is used to adhere to the front face of the protective sheet in order to provide easy manual disengagement of the magnetic attraction and outward flexing of the protective sheet to allow removal of the display sheet and/or the protective sheet and the insertion of a new one.

The display assembly provided is inexpensive to manufacture and is it also inexpensive to change the display compared to usual display assembly.

Other objects and further scope of applicability of the present invention will become apparent from the detailed description given hereinafter.

The features of the present invention which are believed to be novel are set forth with particularity in the appended claims.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

Figure 1:
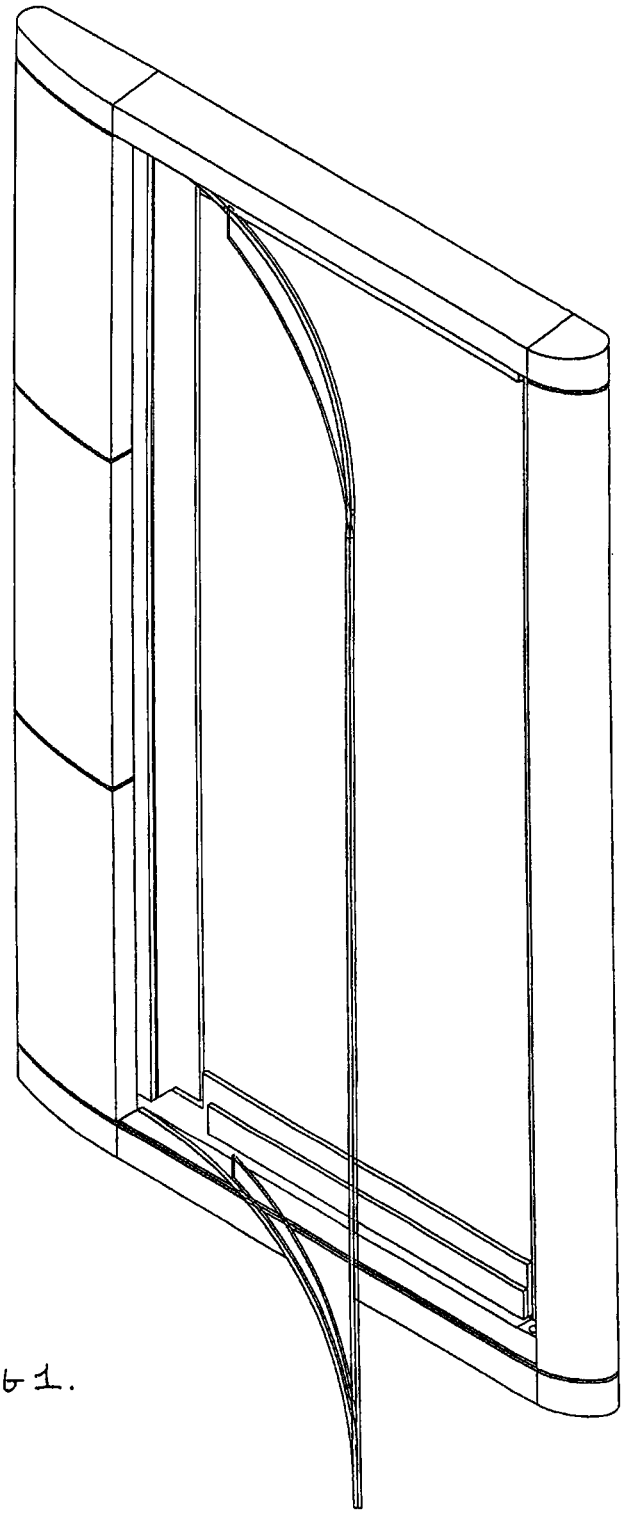
FIG. 1 is a perspective view of a display assembly made in accordance with the present invention, with the protective sheet flexed outwardly.
Figure 2:
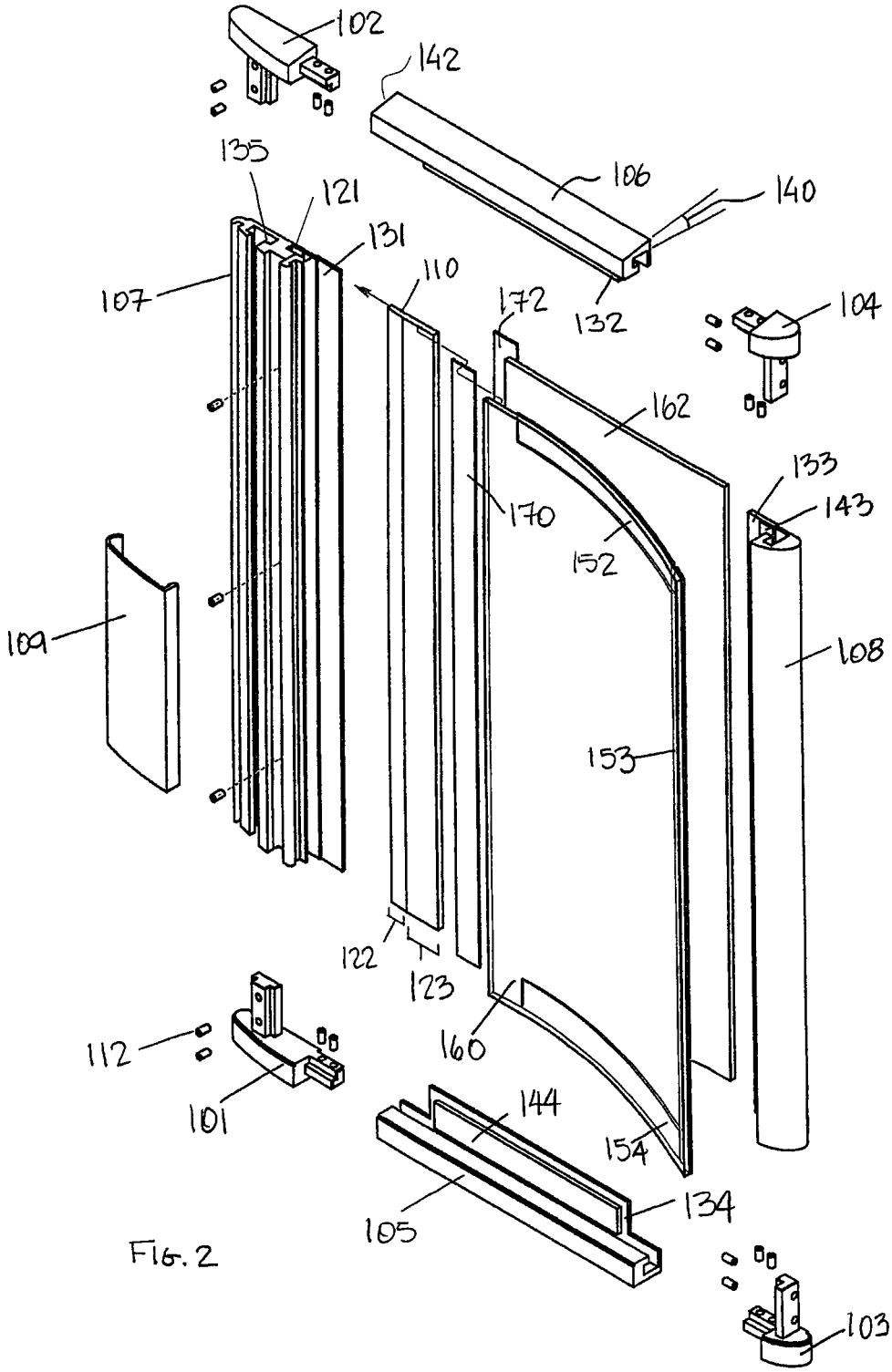
FIG. 2 is an exploded perspective view of a display assembly made in accordance with the present invention.

Referring to FIG. 2, there is shown a display assembly in an exploded view, having a frame formed by a plurality of frame members, namely top member 106, bottom member 105 and side members 107 and 108. These members are connected together at their distal ends, to form a rectangular display assembly, with corner parts 101, 102, 103 and 104. These four members (105, 106, 107 and 108) are preferably formed of extruded material. The corner parts are inserted in their corresponding frame members and fasteners (such as 112) are preferably used to secure the frame assembly. The top surface 142 of the top member 106 is slightly leaning downward. The slight angle 140 created causes rainwater to flow off the top surface 142.

In this embodiment, there is provided a frame cover 109, which is clipped on the side member 107 having a complementary shape. It is to be noted that the entire frame could be adapted to receive covers even if only one frame member is covered in this embodiment. The cover is preferably made of an inexpensive material such as, for example, polyvinyl chloride (PVC) or acrylonitrile butadiene styrene (ABS). This cover may be changed from time to time for an esthetical effect. For example, the cover may be adapted to fit with the display sheet that is displayed in the display assembly. The cover is preferably clipped on the frame, thus no special tools are needed for the replacement of the cover. Furthermore, there is no need to dismount the frame assembly to do so. The cover gives access to the screws and/or other fastening means to the wall surface, while protecting against vandalism when cover is installed.

Onto the abutting surfaces 131, 132 and 133 of the frame members 105, 106 and 108 is fixedly mounted a first set of strips of a ferro-magnetic material (only two are visible; 143 and 144). A second set of strips is fixed (152, 153, 154) on the protective sheet 160 and are disposed to magnetically engage with the first set of strips. The first set and the second set of strips of ferro-magnetic material have a complementary shape, keeping the protective sheet in a closed configuration on the frame members.

The rectilinear side member 107 comprises a groove 121 in which the portion 122 of the strip 110 will be inserted. The portion 123 of the strip 110 is fixed to the protective sheet 160, preferably with a double sided adhesive band 170. A supporting sheet 162 is located between the protective sheet 160 and the back of the display assembly. The supporting sheet 162 is preferably fixed to the rectilinear side member 107 with a double sided adhesive band 172. The supporting sheet 162 is preferably an opaque, supple and resilient screen made of white styrene, typically of a 0.5 mm thickness. The use of a supporting sheet 162 made of styrene prevents the display sheet from wrinkling or ondulating.

The rectilinear side member 107 comprises a groove 121 in which the portion 122 of the strip of the hinge 110 will be inserted. The portion 123 of the hinge 110 is fixed to the protective sheet 160, preferably with a double sided adhesive band 170. A supporting sheet 162 is located between the protective sheet 160 and the back of the display assembly. The supporting sheet 162 is preferably fixed to the rectilinear member 107 with a double sided adhesive band 172. The supporting sheet is preferably an opaque, supple and resilient screen made of white styrene, typically of a 0.5 mm thickness. The use of a supporting sheet made of styrene prevents the display sheet from wrinkling or ondulating.

To fix the display assembly on a surface, fasteners (not shown) are preferably disposed on the frame members, preferably on abutting surfaces 131, 132, 133, 134 or on surface 135. The cover, once installed, conveniently hides such fasteners, thereby protecting against vandalism and theft.

The thickness of the strip 110 is determined so that a constant separation exists between the protective sheet 160 and the frame member portion. This separation is such that it may receive one or more sheet(s) of material when the protective sheet is flexed outwardly.

Figure 3:
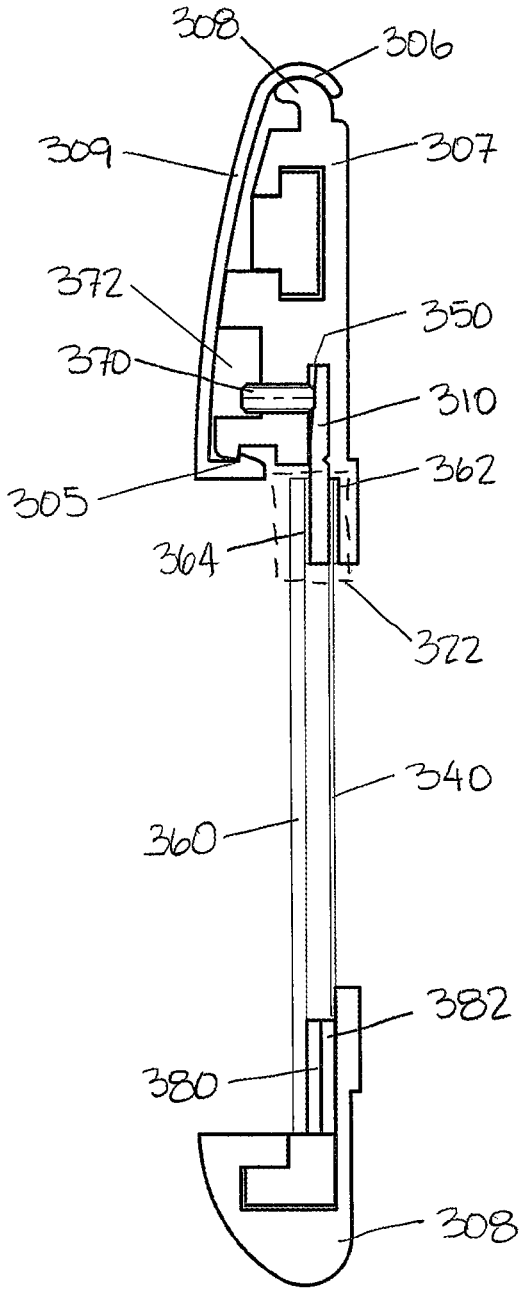
FIG. 3 is a top cross-sectional view of an embodiment of the display assembly comprising a protective sheet and a supporting sheet.

FIGS. 3, 4, 7 and 9 show embodiments of the display assembly without a rear panel, for installation on a surface. Referring to FIG. 3, the strip 310 is fixed along the side of the protective sheet 360 and a portion of the strip 310 extends outwardly along one of its edges. The protective sheet 360 is preferably fixed to the strip 310 with a double sided adhesive band 364 (see box 322). Preferably, a securing part 370, which may comprise screws pressing against the outward portion of the strip 310, for enhanced grip, is used to secure the strip 310 in the groove 350 of the rectilinear frame member 307. The screw(s) is secured through an opening 372 in the frame member. As shown in the FIG. 3, the outward portion of the strip 310 is preferably tapered. The securing part 370 may be alternatively be made of a resilient material pressing against the outward portion of the strip 310. The cover 309, once installed, conveniently hides the screw(s) of the securing part 370, thereby protecting against vandalism and theft.

The thickness of the hinge 110 is determined so that a constant separation exists between the protective sheet and the frame member portion. This separation is such that it may receive one or more sheet(s) of material when the protective sheet is flexed outwardly.

FIGS. 3, 4, 7 and 9 show embodiments of the display assembly without a rear panel, for installation on a surface. Referring to FIG. 3, the hinge is shown in the box 322, the hinge being composed by the strip 310 and a portion of the protective sheet 360. The strip 310 of the hinge 322 is fixed along the side of the protective sheet 360 and a portion of the strip 310 extends outwardly along one of its edges. The protective sheet 360 is preferably fixed to the strip 310 with a double sided adhesive band 364. Preferably, a securing part 370, which may comprise screws pressing against the strip of the hinge, for enhanced grip, is used to secure the strip 310 in the groove 350 of the rectilinear frame member 307. As shown in the FIG. 3, the strip 310 is preferably tapered. The securing part 370 may be alternatively be made of a resilient material allowing it to press against the strip 310. The cover, once installed, conveniently hides such screws, thereby protecting against vandalism and theft.

Figure 9:
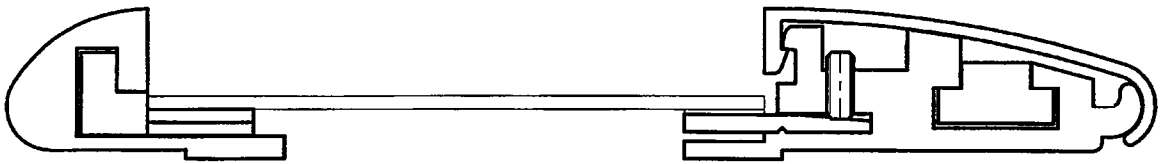
FIG. 9 is a top cross-sectional view of another embodiment of the display assembly comprising only a protective sheet.

The display assembly may be supported by attaching the bottom frame member or the side members to a stand or even may be held by the top frame member. Preferably, a supporting sheet 340 is located between the back of the display assembly and the protective sheet 360 so that, in that embodiment, the poster or printed material to be displayed will be held between the protective sheet 360 and the supporting sheet 340 of the display assembly, thereby snugly pressing the display material in place so as to flatten its surface and smooth out any eventual crinkles and/or folds. The supporting sheet 340 is preferably fixed to the frame member 307 with a double sided adhesive band 362. Alternatively, FIG. 9 shows same embodiment as FIG. 3 without a supporting sheet.

Embodiment of FIG. 3 may also be used for installment on a transparent surface (not shown), in which case it is also possible to display a poster on the back side of the display assembly: a first display sheet for front view may be disposed between the protective sheet 360 and the supporting sheet 340, while a second display sheet for rear view through the transparent surface on which the display assembly is to be installed, may be located between the supporting sheet and the transparent surface. Alternatively, a second display sheet for front view may be disposed between the first display sheet and the supporting sheet 340.

The magnetic strip 380 is fixed onto the protective sheet 360 and the magnetic strip 382 on the abutting surface 333 of the frame member 308.

The frame cover 309 is connected to the frame member 307 which has a complementary shape to receive the cover 309. The frame cover 309 is retained by the internal portions 305 and the external portion 306. The portion 305 interlocks with a portion of the frame member 307 and the portion 309 is forced to mate the portion 318 of the frame member 307 and is thus "clipped" on the frame member 307.

Figure 4:
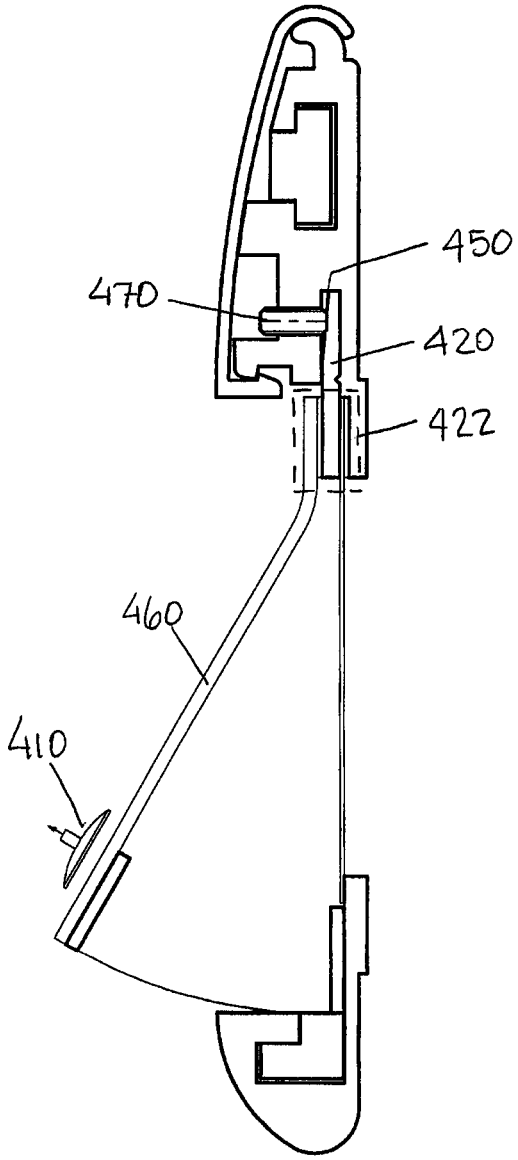
FIG. 4 is a top cross-sectional view of the embodiment of FIG. 3 wherein the protective sheet is outwardly flexed.

As shown in FIG. 4, a suction cup 410 is preferably used to outwardly flex the protective sheet 460. The protective sheet 460 flexes near the strip 420 (see box 422) which is inserted and retained in the groove 450. The securing part 470 presses against the strip 420 and secures it into the groove 450.

As shown in FIG. 4, a suction cup 410 is preferably used to outwardly flex the protective sheet 460. The protective sheet 460 flexes near the hinge 422 which is inserted and retained in the groove 450. The securing part 470 presses against the strip 420 and secures it into the groove 450.

Figure 5:
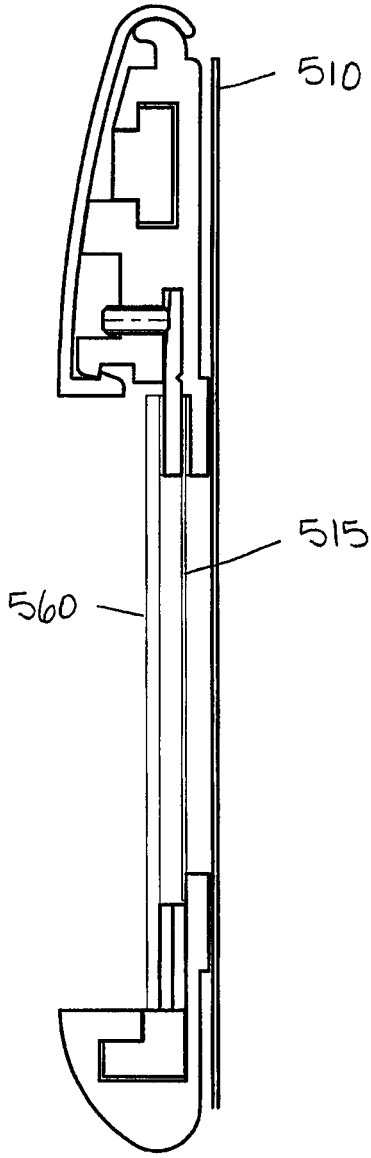
FIG. 5 is a top cross-sectional view of another embodiment of the present invention further comprising a rear panel.
Figure 6:
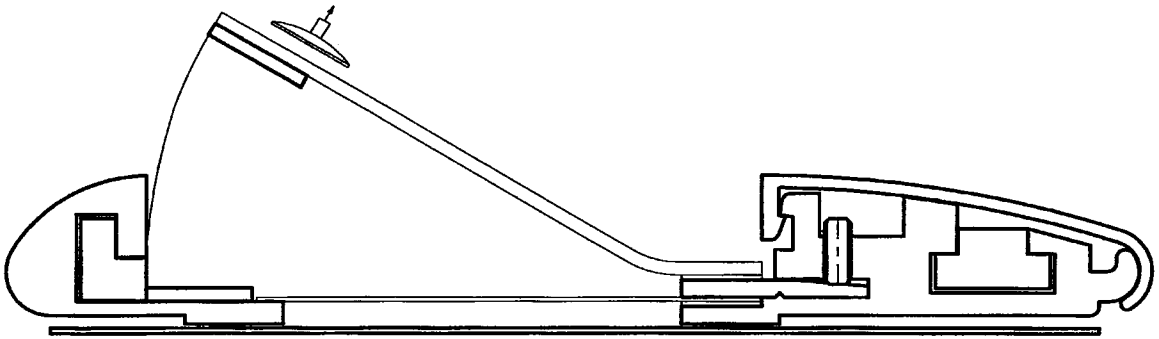
FIG. 6 is a top cross-sectional view of the embodiment of FIG. 5 wherein the protective sheet is outwardly flexed.
Figure 8:
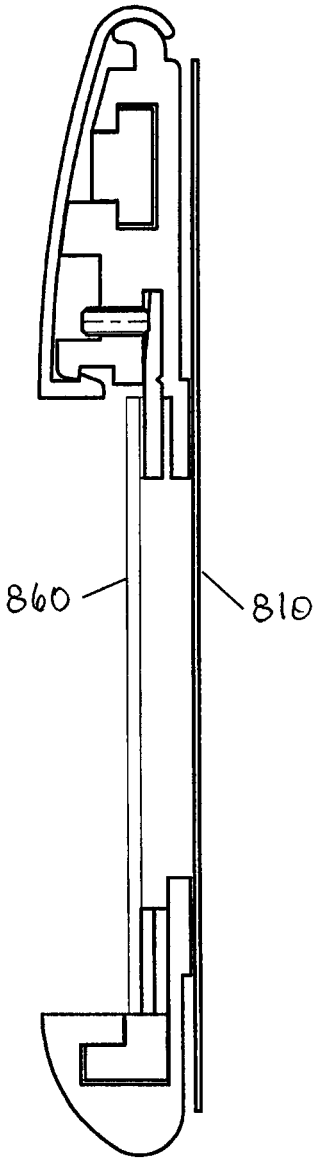
FIG. 8 is a top cross-sectional view of another embodiment of the display assembly comprising a protective sheet and a rear panel.

FIGS. 5, 6 and 8 show embodiments of the display assembly with a rear panel, for freestanding applications, without need for installation on a surface. Referring to FIG. 5, a rear panel 510 is shown, as fixed on the back side of the display assembly. The rear panel 510 provides additional rigidity and autonomy to the assembly. In that embodiment, the poster to be displayed will still be held between the protective sheet 560 and the supporting sheet 515 of the display assembly. However, FIG. 8 shows an embodiment where the poster to be displayed is directly held between the protective sheet 860 and the rear panel 810 of the display assembly without any supporting sheet. For the embodiments of FIGS. 5 and 8, there is no need for said assembly to be mounted or attached on a surface: the display may be standing freely, supported via at least one frame member. If there is a need to view a display sheet from both the front and the back of the display assembly, the rear panel is transparent. Otherwise, the rear panel may be opaque.

Alternatively, in FIG. 5 or 8, the rear panel 510 or 810 will be transparent, and both sides of the display assembly may then be used to expose both surfaces of the display sheet, while being protected. In these embodiments, a hiding frame may be disposed on the rear panel to hide the frame of the display assembly, only the rear display sheet being visible through the rear panel.

Preferably, the frame members are made of polymeric material or an extrudable metal such as aluminium for example. The corner parts are preferably molded and made of ZAMAK™, an alloy made of zinc, aluminium, magnesium and copper. The protective sheet is a transparent flexible plastic material, such as acrylic (PMMA), polycarbonate (PC), acrylonitrile butadiene styrene (PETG) or polyethylene terephthalate (PET). The strips of ferro-magnetic material on the protective sheet are capable of being flexed to follow the curvature of the protective sheet as it is outwardly flexed to receive a display sheet.

In operation, when display material is to be installed and/or replaced, suction cup 410 is attached on the protective sheet, allowing user to apply an outward force against the magnetic force between the first and second set of strips of a ferromagnetic material, allowing to pull outwardly the protective sheet. A display sheet may then be installed inside the display assembly, directly as in embodiments shown in FIGS. 8 and 9, or against the supporting sheet as shown in FIGS. 3 to 7.

Figure 7:
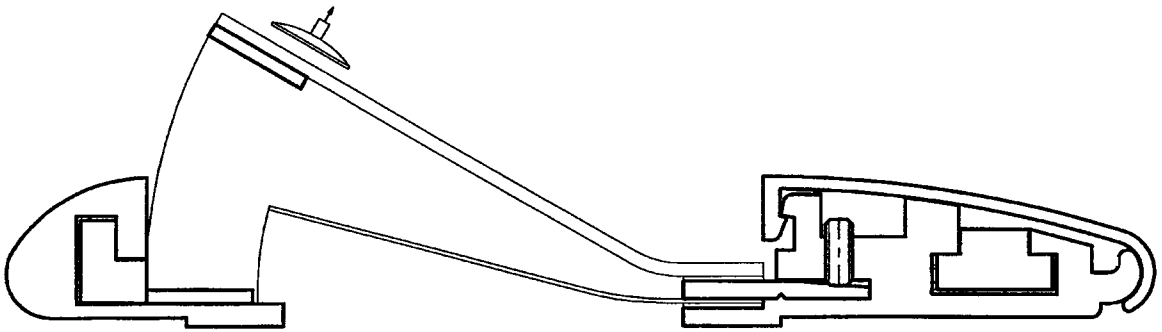
FIG. 7 is a top cross-sectional view of the embodiment of FIG. 3 wherein the protective sheet and the supporting sheet are outwardly flexed.

In those embodiments of FIGS. 3, 4, 7 and 9, when the display assembly is mounted on a transparent surface, such as a shop window, the user may wish to flex outwardly supporting sheet 340, as shown on FIG. 7, insert a second display sheet between the supporting sheet and the surface on which the display assembly is mounted for rear view through the transparent surface, and then put the supporting sheet back in place.

In those embodiments of FIGS. 5 and 6, when display assembly has a rear panel, and only when said rear panel is transparent, user may wish to flex outwardly the supporting sheet, insert a second display sheet between the supporting sheet and the rear panel for viewing through the transparent rear panel, and then put the supporting sheet back in place.

Once installation of the display sheet is completed, the protective sheet may be released and magnetic attraction forces between the first and second set of strips of a ferromagnetic material will bring the protective sheet back against the frame members, closing the display assembly.

When it is necessary to remove the protective sheet 460 to replace it by a new one, the securing part 470 is released, the protective sheet is simply pulled out of the groove 450 and a new one is inserted. This operation does not need any other tools than the suction cup. A screwdriver may be necessary only if the securing part comprises screws.

Should there be a need to replace frame cover 309, because it has been damaged, to replace network identification or for other reason, a user may pull out the cover by unclipping it out from the frame member having a complementary shape and clip in place a new cover. This operation does not need any tool.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

The invention claimed is:

1. A display assembly for the display of at least one display sheet, said display assembly comprising:

a. a frame formed of a plurality of frame members having abutting surfaces, at least one of said frame members being rectilinear, said at least one rectilinear frame member comprising a groove;

b. a flexible protective sheet having at least one longitudinal edge, said protective sheet comprising a strip extending along said at least one longitudinal edge, said strip having a portion extending outwardly of said protective sheet along said at least one longitudinal edge and configured to be removably received and retained in said groove, said protective sheet being outwardly flexible about said strip when said portion of said strip is received and retained in said groove;

c. means to magnetically hold said protective sheet to said frame members against said abutting surfaces;

wherein said protective sheet and said strip are configured to allow the installation and/or removal of said at least one display sheet without removing said strip from said groove;

wherein said groove is configured to removably receive and retain said portion of said strip whereby said strip and said protective sheet are removable from said groove without disassembling said frame.

2. The display assembly of claim 1, further comprising at least one frame cover, wherein said cover is adapted to be removably clipped on at least one of said frame members to change the appearance of said display assembly without dismantling said display assembly.

3. The display assembly of claim 2, wherein said at least one of said frame members comprises an internal portion and an external portion adapted to retain said cover on said at least one of said frame members.

4. The display assembly of claim 2, wherein the shape of said cover is complementary to at least a portion of said at least one of said frame members.

5. The display assembly of claim 1, wherein said portion of said strip is removed from or inserted into said groove by sliding said portion of said strip perpendicularly to said at least one rectilinear frame member.

6. The display assembly of claim 1, wherein said portion of said strip is frictionally engaged in said groove.

7. The display assembly of claim 6, wherein said portion of said strip is tapered.

8. The display assembly of claim 2, further comprising a securing part configured to apply a pressure on said portion of said strip.

9. The display assembly of claim 8, wherein said securing part comprises at least one screw pressing against said portion of said strip to secure said portion of said strip into said groove.

10. The display assembly of claim 9, wherein said cover hides said at least one screw.

11. The display assembly of claim 8, wherein said securing part is made from a resilient material.

12. The display assembly of claim 1, wherein at least one of said frame members having a surface susceptible to receive water or snow slightly leans downward to force said water or said snow to flow off from said at least one of said frame members.

13. The display assembly of claim 1, wherein at least some of said frame members comprise ferromagnetic material parts.

14. The display assembly of claim 1, wherein said magnetic holding means comprise flexible strips of ferromagnetic material attached to said protective sheet.

15. An assembly for the display of sheets, posters or the like, comprising:

a. a frame formed of a plurality of frame members having abutting surfaces, at least one of said frame members being rectilinear, said at least one rectilinear frame member comprising a groove;

b. a flexible protective sheet having at least one longitudinal edge, said protective sheet comprising a strip extending along said at least one longitudinal edge, said strip having a portion extending outwardly of said protective sheet along said at least one longitudinal edge and configured to be removably received and retained in said groove, said protective sheet being outwardly flexible about said strip when said portion of said strip is received and retained in said groove;

c. means to magnetically hold said protective sheet to said frame members against said abutting surfaces;

wherein said protective sheet and said strip are configured to allow the installation and/or removal of said at least one display sheet without removing said strip from said groove;

wherein said groove is configured to removably receive and retain said portion of said strip and wherein said portion of said strip is insertable into and removable from said groove by sliding said protective sheet in a direction substantially perpendicular to said at least one rectilinear frame member whereby said protective sheet is mountable to and dismountable from said frame without disassembling said frame.

16. The display assembly of claim 15, further comprising at least one frame cover, wherein said at least one frame cover is adapted to be removably clipped on at least one of said frame members to change the appearance of said display assembly without dismantling said display assembly.

17. The display assembly of claim 15, wherein said portion of said strip is tapered.

18. The display assembly of claim 15, further comprising a securing part adapted to apply a pressure on said portion of said strip.

19. The display assembly of claim 18, wherein said securing part comprise at least one screw pressing on said portion of said strip to secure said portion of said strip into said groove.

20. The display assembly of claim 18, wherein said securing part is made from a resilient material.

* * * * *